US011740568B2

(12) United States Patent
Cohen et al.

(10) Patent No.: US 11,740,568 B2
(45) Date of Patent: Aug. 29, 2023

(54) REDUCING REFLECTANCE VARIANCES OF PHOTOCONDUCTIVE SURFACES

(71) Applicant: Hewlett-Packard Development Company, L.P., Spring, TX (US)

(72) Inventors: Lavi Cohen, Ness Ziona (IL); Sasha Zilbershtein, Ness Ziona (IL); Michael Vinokur, Ness Ziona (IL); Michael Plotkin, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/262,242

(22) PCT Filed: Sep. 18, 2018

(86) PCT No.: PCT/US2018/051566
§ 371 (c)(1),
(2) Date: Jan. 22, 2021

(87) PCT Pub. No.: WO2020/060540
PCT Pub. Date: Mar. 26, 2020

(65) Prior Publication Data

US 2021/0263440 A1 Aug. 26, 2021

(51) Int. Cl.
*G03G 15/00* (2006.01)
*G03G 15/043* (2006.01)

(52) U.S. Cl.
CPC ..... *G03G 15/043* (2013.01)

(58) Field of Classification Search
USPC ..... 399/177, 159
See application file for complete search history.

(56) References Cited

U.S. PATENT DOCUMENTS

| | | | | |
|---|---|---|---|---|
| 3,656,200 | A | 4/1972 | Riley | |
| 4,066,351 | A * | 1/1978 | Kidd | G03G 15/04027 399/180 |
| 5,245,387 | A * | 9/1993 | Kubo | G03G 15/0115 355/71 |
| 5,826,145 | A | 10/1998 | Fukae | |
| 6,215,967 | B1 | 4/2001 | Takeda et al. | |
| 6,763,205 | B2 | 7/2004 | Izawa et al. | |
| 8,331,812 | B2 | 12/2012 | Yasutomi | |
| 2006/0024081 | A1 | 2/2006 | Gila et al. | |
| 2007/0084371 | A1 * | 4/2007 | Nagler | B41F 27/1231 101/415.1 |
| 2007/0292153 | A1 | 12/2007 | Araya | |
| 2008/0056768 | A1 | 3/2008 | Yanagihara | |

(Continued)

FOREIGN PATENT DOCUMENTS

| | | | |
|---|---|---|---|
| CN | 101105674 | A | 1/2008 |
| CN | 107430373 | A | 12/2017 |

(Continued)

*Primary Examiner* — Quana Grainger

(57) ABSTRACT

In an example of the disclosure, an imaging oil is applied upon a photoconductor surface. An element is brought into contact with the imaging oil at the photoconductor surface. The element has a first refractive index that is within a predefined tolerance of a second refractive index of the imaging oil. The photoconductor surface is exposed to light emitted by a writing component. The light passes through the element and the imaging oil.

20 Claims, 8 Drawing Sheets

(56) References Cited

U.S. PATENT DOCUMENTS

| | | | | |
|---|---|---|---|---|
| 2010/0226702 | A1* | 9/2010 | Nuriel | G03G 21/0058 399/345 |
| 2013/0288171 | A1* | 10/2013 | Ganapathiappan | G03G 5/14734 430/58.65 |
| 2013/0327236 | A1* | 12/2013 | Kahatabi | G03G 15/11 101/131 |
| 2015/0160586 | A1* | 6/2015 | Sandler et al. | G03G 5/14734 430/58.65 |
| 2018/0024492 | A1* | 1/2018 | Borenstain | G03G 21/0088 399/348 |

FOREIGN PATENT DOCUMENTS

| | | |
|---|---|---|
| EP | 1574915 | 9/2005 |
| JP | 2005352310 | 4/1972 |
| JP | 2002169406 | 6/2002 |
| WO | WO-2016165760 A1 | 10/2016 |

* cited by examiner

REDUCING REFLECTANCE VARIANCES OF PHOTOCONDUCTIVE SURFACES

BACKGROUND

A print apparatus may apply print agents to a paper or another substrate. In one example, a print apparatus may apply a print agent that is an electrostatic printing fluid (e.g., electrostatically chargeable toner or resin colorant particles dispersed or suspended in a carrier fluid). Such a system is commonly referred to as a LEP printing system. In other examples, a print apparatus may apply a print agent via a dry toner or an inkjet printing technology.

DRAWINGS

FIGS. 4A, 4B, 5A, and 5B are simple schematic diagrams that illustrate examples of utilizing an element contacting imaging oil at a photoconductive surface to address photoconductor reflectance variance issues during printing.

Figure 6:
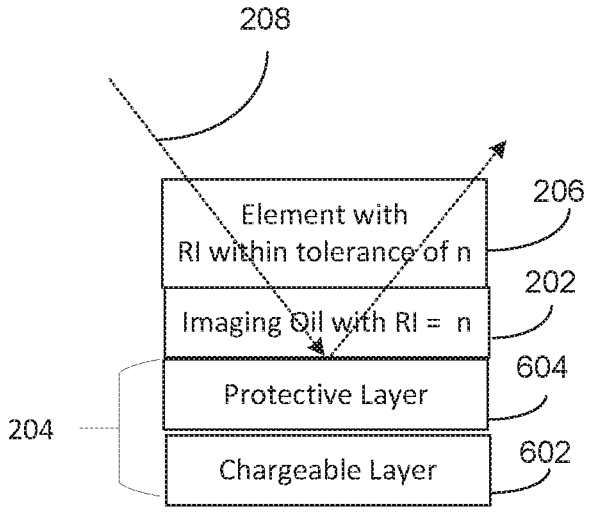

FIG. 6 is a simple schematic diagram illustrating an example of bringing an element into contact with imaging oil at a photoconductor surface with a chargeable layer and a protective layer.

Figure 7:
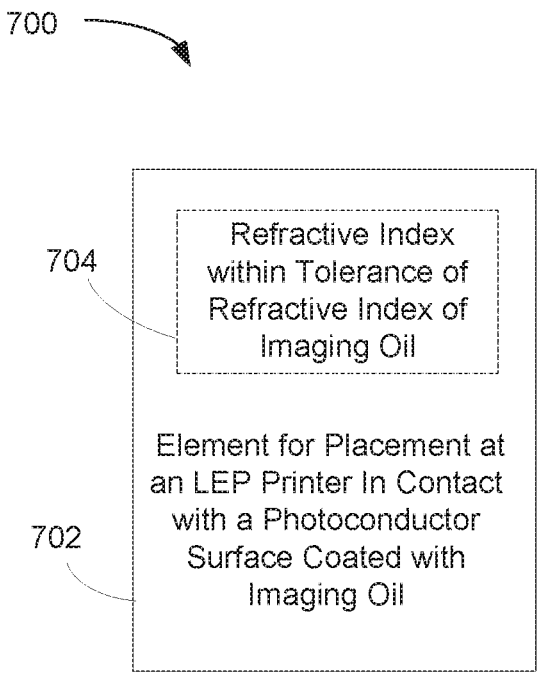

FIG. 7 is a block diagram depicting an example of an optical device for addressing photoconductor reflectance variance issues during LEP printing.

Figure 8:
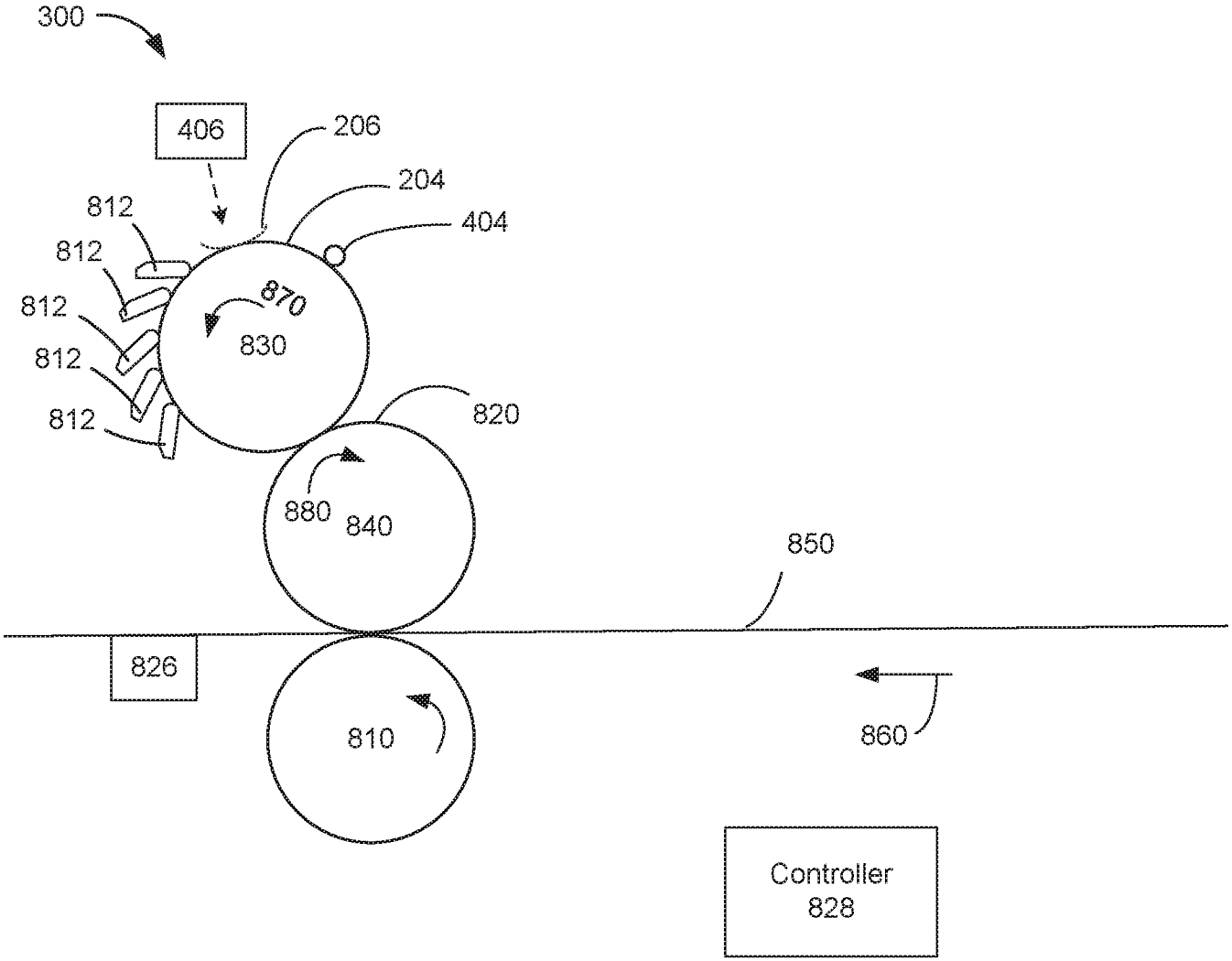

FIG. 8 is a simple schematic diagram illustrating a cross section of a LEP printer including a system to address photoconductor reflectance variances during printing, according to an example of the principles described herein.

DETAILED DESCRIPTION

In an example of LEP printing, a printer may form an image on a print substrate by placing an electrostatic charge on a photoconductor, and then utilizing a laser scanning unit, LED writing head, or other writing component to apply an electrostatic pattern of the desired image on the photoconductor to selectively discharge the photoconductor. The selective discharging forms a latent electrostatic image on the photoconductor. The printer includes a development station to develop the latent image into a visible image by applying a thin layer of electrostatic ink (which may be generally referred to as "LEP ink", or "electronic ink" in some examples) to the patterned photoconductor. Charged toner particles in the LEP ink adhere to the electrostatic pattern on the photoconductor to form a liquid ink image. In examples, the liquid ink image, including colorant particles and a carrier fluid, is transferred utilizing a combination of heat and pressure from the photoconductor to an intermediate transfer member (referred herein as a "blanket"). In an example, the blanket may be, or may be attached to, a rotatable drum. In another example, the blanket may be a belt driven that is to be driven by a series of rollers. In examples the blanket may be a consumable or replaceable blanket. The blanket is heated until carrier fluid evaporates and colorant particles melt, and a resulting molten film representative of the image is applied.

In examples, the photoconductor surface upon which the latent electrostatic image is to be formed has had a thin layer of imaging oil applied. The imaging oil layer is to facilitate the application of ink layers from the development station to the photoconductor surface. In certain applications, the imaging oil layer may be a residual from a wiping operation performed by a cleaning station for the photoconductor. In certain applications, the cleaning station will apply a thin layer, e.g. a 10-100 nm, of imaging oil to extend the lifespan and performance of the photoconductive surface (e.g., delay/slow down the rate of oxidization of imaging oil). In certain applications, imaging oil will additionally facilitate the transfer of inked images from the photoconductor surface to the blanket. A significant challenge with some LEP printers, however, is that variations in imaging oil layer thickness at the photoconductor surface beneath the writing component can cause significant print quality issues. The print quality is affected as the writing component's selective discharging of the photoconductor to form a latent image is impaired by inconsistent reflectance of the photoconductor surface. In certain applications, an imaging oil thickness of variation of 5-10 nm can result in a visible print quality defect on the printed substrate. In some applications, increasing imaging oil thickness at the photoconductor surface to decrease reflectance variations will not be effective to improve print quality as applying to the photoconductor a layer of imaging oil at a thickness that would be needed to address reflectance variations would result in imaging oil splashes off the photoconductor and charging issues. In some implementations splashes and charging issues can occur with imaging oil thickness of 10 microns or more, causing significant print quality issues and damage other critical printer components.

To address these issues, various examples described in more detail below provide a system and a method for reducing photoconductor reflectance variance issues during printing. In an example of the disclosed method, an imaging oil is applied upon a photoconductor surface. An element is brought into contact with the imaging oil at the photoconductor surface. The element has a first refractive index that is within a predefined tolerance of a second refractive index of the imaging oil. The photoconductor surface is exposed to light emitted by a writing component, with the light passing through the element and the imaging oil. In a particular example, the element is to stay in contact with the surface of the photoconductor without an air gap due to capillary action of imaging oil present in a nip between the element and the photoconductor surface. In an example, the light emitted by the writing component has an established or known wavelength range, and the element is transparent to the light in the wavelength range.

In another example of the disclosure, an LEP printer includes a rotatable drum with a photoconductor surface coated with imaging oil. The LEP printer includes a flexible sheet positioned to be in contact with imaging oil at the photoconductor surface. The sheet has a first refractive index that is within a predefined tolerance of a second refractive index of the imaging oil.

In another example of the disclosure, an optical device is provided for reducing photoconductor reflectance variance issues at an LEP printer. The optical device includes an element for placement at the printer in contact with a photoconductor surface coated with imaging oil. The element has a refractive index that is within a predetermined tolerance of a refractive index of the imaging oil.

In this manner the disclosed method, LEP printer, and optical device provide for effective and efficient reduction or elimination of print quality issues that are attributable to imaging oil layer thickness variation at a photoconductor surface. By bringing the element that has a refractive index that the same or within a tolerance of the refractive index of the imaging oil at a photoconductor surface into contact with the imaging oil, the disclosed method, LEP printer, and optical device can "virtually" increase the thickness of the imaging oil so that reflectance variance at the photoconductor is minimized. Optically, having an element with a specific refractive index in place to be in contact with imaging oil at a photoconductor surface can be equivalent or nearly equivalent to having imaging oil at the photoconductor surface at the same thickness. This enables avoidance of photoconductor reflectance variance issue without the splashing, charging issues, and component damage that can result from having an imaging oil layer that is too thick for the LEP printer. The disclosed method, LEP printer, and optical device should be particularly beneficial for LEP printers with photoconductor surfaces that are sensitive to imaging oil thickness variation under the writing component, including, but not limited to LEP printers including an amorphous silicon (aSi) drum. However, the disclosed method, LEP printer, and optical device are likewise applicable to LEP printers with an organic photoconductor or a conventional photoconductor plate mounted on a drum.

Users and providers of LEP printer systems and other printer systems will appreciate the improvements in print quality and the reductions in damage to print apparatus components and reductions in downtime afforded by utilization of the disclosed examples. Installations and utilization of LEP printers that include the disclosed method, LEP printer, and optical device should thereby be enhanced.

Figure 1:
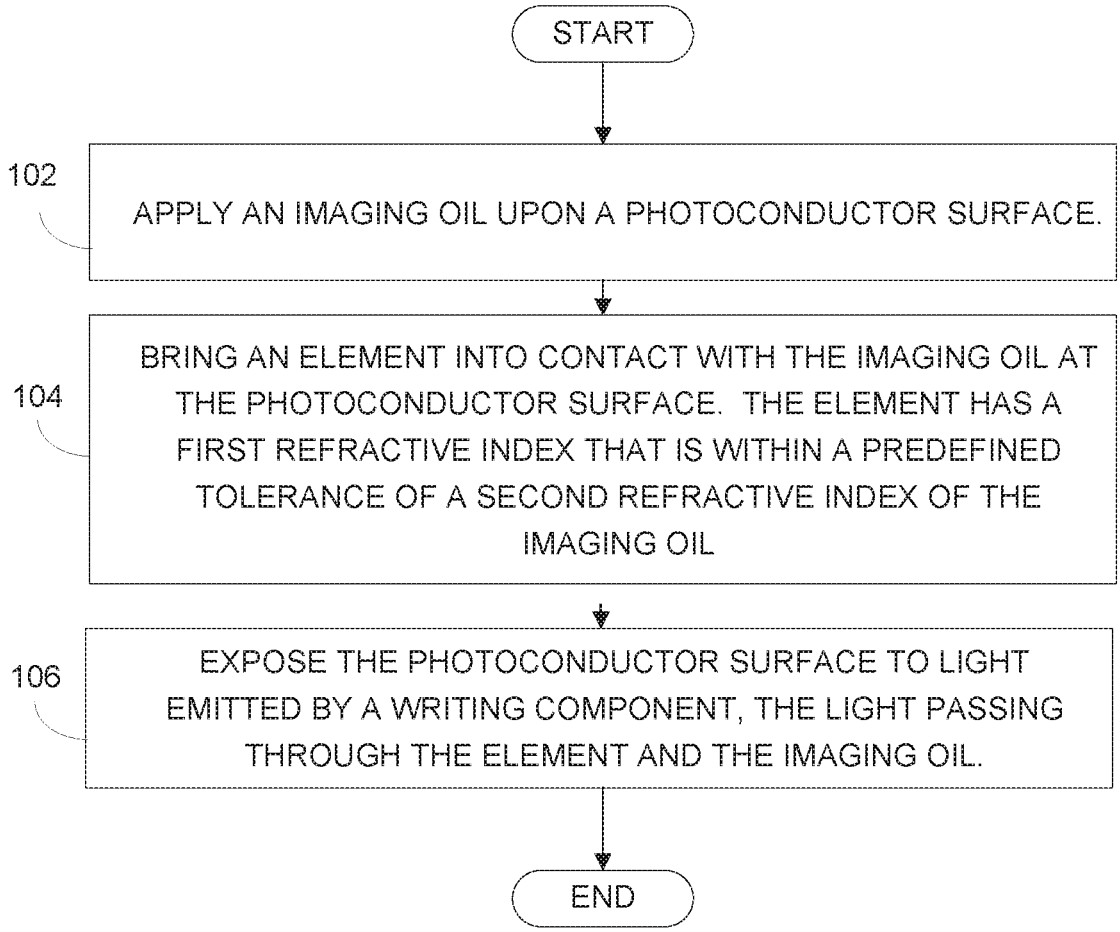
FIG. 1 is a flow diagram depicting an example implementation of a method for reducing photoconductor reflectance variance issues during printing.

FIG. 1 is a flow diagram of implementation of a method for reducing photoconductor reflectance variance issues during printing. In an example, an imaging oil is applied upon a photoconductor surface (block 102). As used herein, "photoconductor" refers generally to a material or a device that becomes more electrically conductive as it is exposed to electromagnetic radiation (e.g., visible light, ultraviolet light, infrared light, or gamma radiation). In an example, the rotating print apparatus component to be cleaned may be a photoconductive cylinder, e.g., a rotating drum with a photoconductive surface. As used herein, "photoconductive" refers generally to a material or a device having a property of becoming more electrically conductive as it is exposed to electromagnetic radiation. In a particular example the drum may be a drum that includes multiple layers, with the outermost layer being a photoconductive surface. In another particular example, the drum may have a consumable outermost photoconductive layer. In yet another example, the drum may be an amorphous silicon ("aSi") drum with a photoconductive outermost layer.

As used herein, "imaging oil" refers generally to a viscous petroleum-based liquid utilized in LEP printing. In an example, an imaging oil reservoir may supply clean imaging oil to a cleaning station for a photoconductor, wherein the cleaning station applies the imaging oil to the photoconductor surface. In certain examples, the imaging oil reservoir may additionally provide imaging oil to ink storage tanks, wherein the imaging oil is to serve as a carrier fluid for the ink as it is distributed to the photoconductor during printing operations. In certain examples, the imaging oil reservoir may include an imaging oil filter assembly with an optical sensor that is to check imaging oil purity and provide a user instruction when the imaging oil level is too low, when the imaging oil is dirty to the point that print quality or printing operations will be affected, and/or when the imaging oil filters need replacing.

Continuing at FIG. 1, an element is brought into contact with the imaging oil at the photoconductor surface. The element has a first refractive index that is within a predefined tolerance of a second refractive index that is the refractive index the imaging oil at the photoconductor surface (block 104). As used herein, a "refractive index" for a medium refers generally to a number that describes how light propagates, e.g., is bent, as the light travels through that medium. In an example, a refractive index may be expresses as where n is n=c/v, where c is the speed of light in vacuum and v is the phase velocity of light in the specified medium.

As used herein, a "predefined tolerance" refers generally to defined, limited, or previously established allowable amount of variation. In an example, the first refractive index of the element may the same as the second refractive index of the photoconductor surface. In another example, the first refractive index of the element may be different than the second refractive index of the photoconductor surface, yet within a range of values that was previously established as acceptable refractive index values. In an example, a printer that includes the photoconductor surface may access, directly or indirectly via communication with another computing device, a listing of predefined tolerances and/or a listing of acceptable refractive index values. In another example, a computing device in network connection with a printer that includes the photoconductor surface may directly or indirectly access the listing of predefined tolerances and/or a listing of acceptable refractive index values.

Continuing at FIG. 1, in an example, the light that is emitted by a writing component at the printing apparatus has a wavelength range, and the element brought into contact with the photoconductor surface is transparent to the light in the wavelength range. In a particular example, the light that is emitted by the writing component may have a wavelength range of 600-900 nm, with the element that is brought into contact with the photoconductor surface being transparent to the light in that wavelength range.

In a particular example, the element is to be automatically selected from a plurality of available elements according to a calculated target thickness, wherein the target thickness is calculated according the formula $$T>\lambda^2/(2\cdot n_{ref}\cdot\Delta\lambda),$$

wherein T is thickness of the element, $\lambda$ is light source central wavelength, $\Delta\lambda$ is light source spectral width, and $n_{ref}$ is refractive index of the element In this manner, an element of appropriate thickness can be selected where a set of elements with a refractive index within a tolerance of the light source are available. For instance, if $\lambda$ light source central wavelength is 650 nm $\Delta\lambda$ light source spectral width is 20 nm, and refractive index of the element is 1.42, calculated appropriate T thickness of the element is T>7440 nm (7.44 micron) $(650\text{ nm})^2/(2*1.42*20\text{ nm})=7440\text{ nm}=7.44$ micron). In this example, the printing apparatus may automatically select an element from a set of available elements, with the selected element having a first refractive index that is within a predefined tolerance of a second refractive index of the imaging oil, and being at or within an acceptable range of the calculated appropriate thickness T>7.44 micron. In an example, the printing apparatus may perform the appropriate element thickness assessment described above and present a user instruction for installation of a selected element having a first refractive index that is within a predefined tolerance of a second refractive index of the imaging oil.

In an example, the element is to stay in contact with the surface of the photoconductor, without air gaps, due to the capillary action of imaging oil located at a nip formed between the element and the photoconductor surface. In an example, the element that is brought into contact with the imaging oil at the photoconductor surface may be a flexible element, e.g. a plastic sheet or film. In another example, the element may be a rigid element, e.g. a glass element or a hard plastic element.

In examples, even if the element is placed directly ("hard-stopped") on the drum, capillary effect will fill with imaging oil air gaps that might occur due to the surface roughness of the element and photoconductor surface. In any event, the element should be chemically compatible with the imaging oil such that there is no degradation of the element, the imaging oil, or the photoconductive surface due to chemical changes.

Continuing with FIG. 1, the photoconductor surface is exposed to light emitted by a writing component, with the light passing through the element and the imaging oil (block 106). In examples, the writing component may be or include a laser, LED, or any other light source In an example, the photoconductor surface has been charged with a charging device, and the writing component is to expose the charged photoconductor surface with light within a specified range of wavelengths as the photoconductor surface rotates to form a latent image pattern upon the photoconductor surface. In this example the element that is in contact with the photoconductor surface is transparent to the light at the range of wavelengths. The latent image pattern is to replicate an image that is to be printed by the printer. In an example, the photoconductor surface may a consumable or replaceable component of the printer.

Figure 2A:
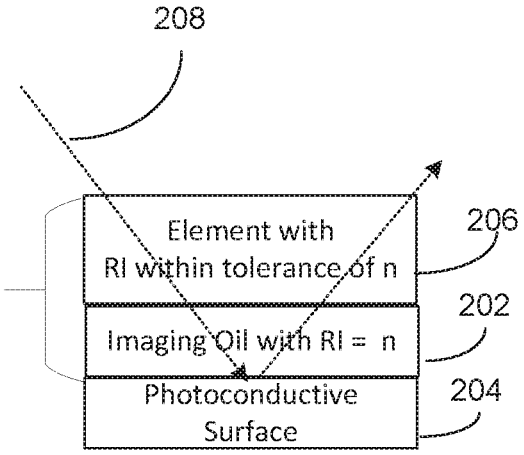
FIGS. 2A and 2B are simple schematic diagrams illustrating an example of bringing an element into contact with imaging oil at the photoconductor to address photoconductor reflectance issues during printing.
Figure 2B:
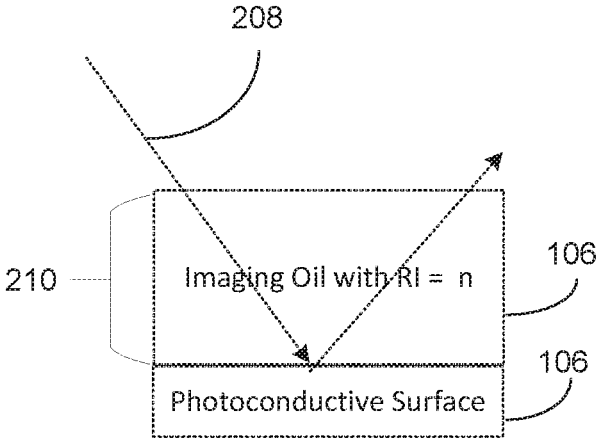

FIGS. 2A and 2B are simple schematic diagrams illustrating an example of bringing an element into contact with imaging oil at the photoconductor surface to address photoconductor reflectance issues during printing. Beginning at FIG. 2A, an imaging oil 202 is applied upon a photoconductor surface 204. An element 206 is brought into contact with imaging oil 202 at photoconductor surface 204. Element 206 has a first refractive index that is within a predefined tolerance of a second refractive index of imaging oil 202. Photoconductor surface 204 is exposed to light 208 emitted by a writing component. Light 208 passes through element 206 imaging oil 202.

Moving to FIG. 2B in view of FIG. 2A, element 206 that has a refractive index that the same or within a tolerance of the refractive index of imaging oil 202 at photoconductor surface 204 is brought into contact with the imaging oil. The thickness of the imaging oil at photoconductor surface 204 is thus virtually increased to be equivalent or nearly equivalent to the case of having imaging oil at the photoconductor surface at the same thickness 210 as the combined thicknesses of imaging oil 202 and element 206 (FIG. 2A). The additive optical effect of the layer of imaging oil 202 and the element 206 provides for effective and efficient reduction or elimination of print quality issues attributable to imaging oil layer thickness variation at a photoconductor surface, without the splashing and charging issues that can be associated a layer of imaging oil that is too thick for an LEP printer.

Figure 3:
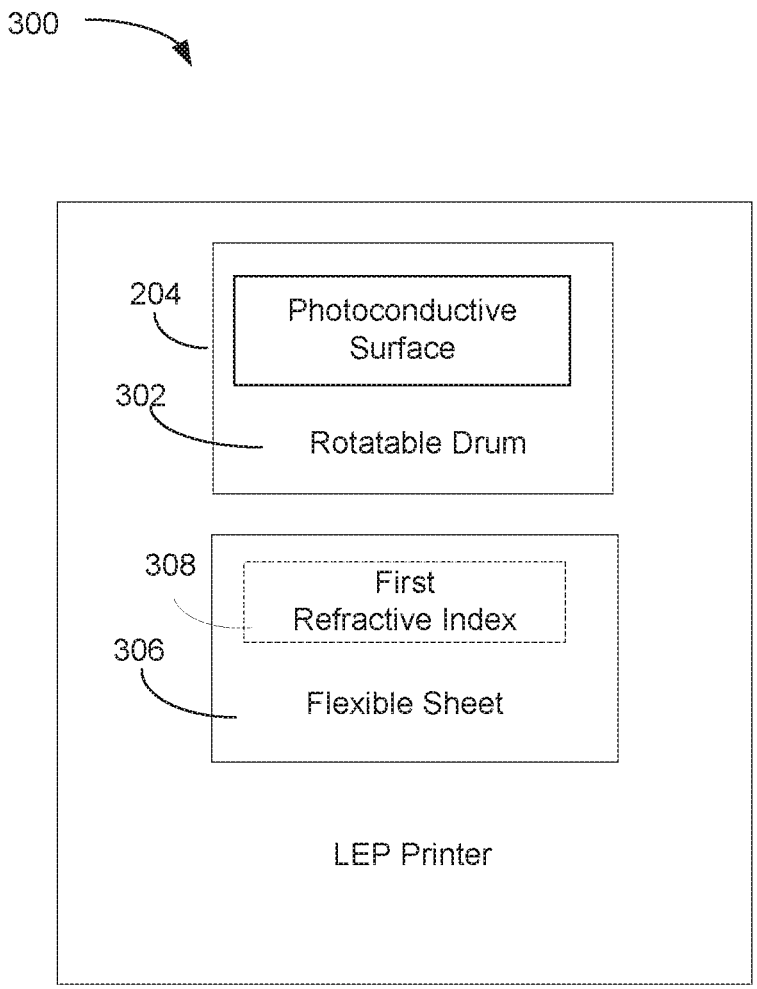
FIG. 3 is a block diagram depicting an example of a LEP printer, the system including rotatable drum with a photoconductive surface, and a flexible sheet positioned to contact imaging oil at the photoconductive surface.

FIG. 3 is a block diagram depicting an example of a LEP printer with components to improve print quality and printer component lifespan by reducing or eliminating reflectance variance at a photoconductor surface. In this example, system 100 includes a rotatable drum 302 with a photoconductive surface 204. The photoconductive surface 204 is to be coated with imaging oil. LEP printer 300 includes a flexible sheet element 306 positioned to be in contact with the imaging oil at photoconductive surface 204. Flexible sheet element 306 has a first refractive index 308 that is within a predefined tolerance of a second refractive index that is the refractive index of the imaging oil at photoconductive surface 204. In an example, flexible sheet element 306 may have a thickness of 10-500 microns so as to have flexibility with a certain amount of rigidity or stiffness. Rigidity or stiffness of flexible sheet element 306 is a function of cross-section inertia (geometry), material mechanical properties, and boundary conditions (mounting technique). These factors can be controlled during design to develop a flexible sheet element with the rigidity or stiffness that is deemed optimal for a certain LEP printer 300.

Figure 4A:
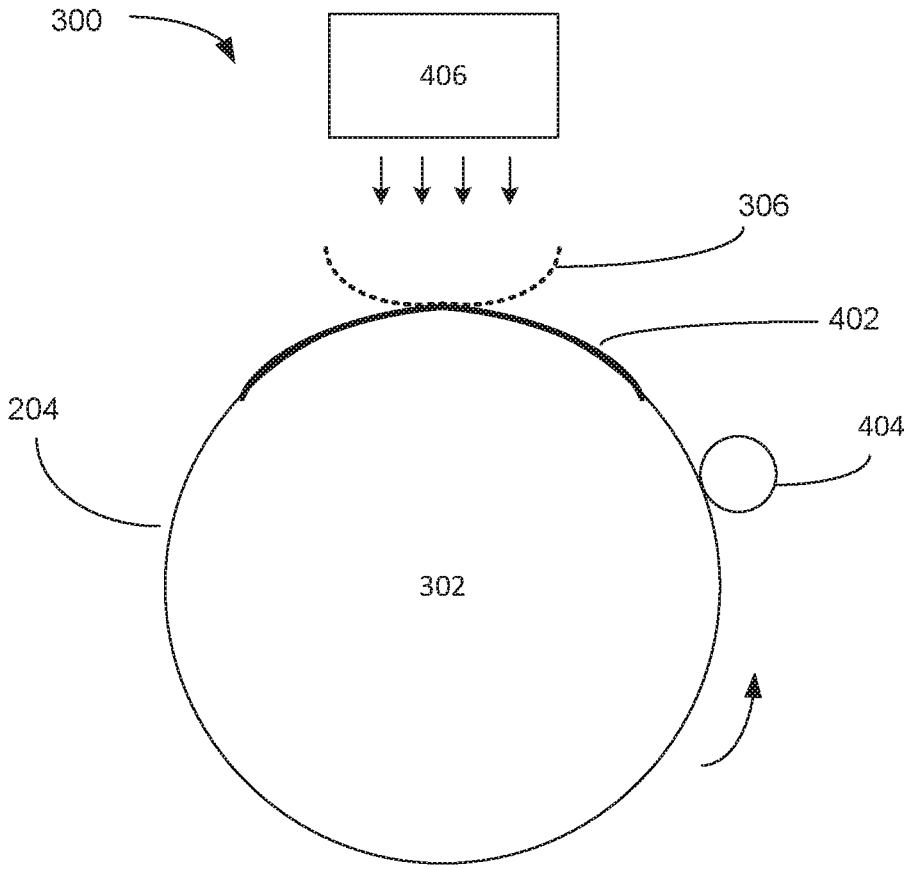
Figure 4B:
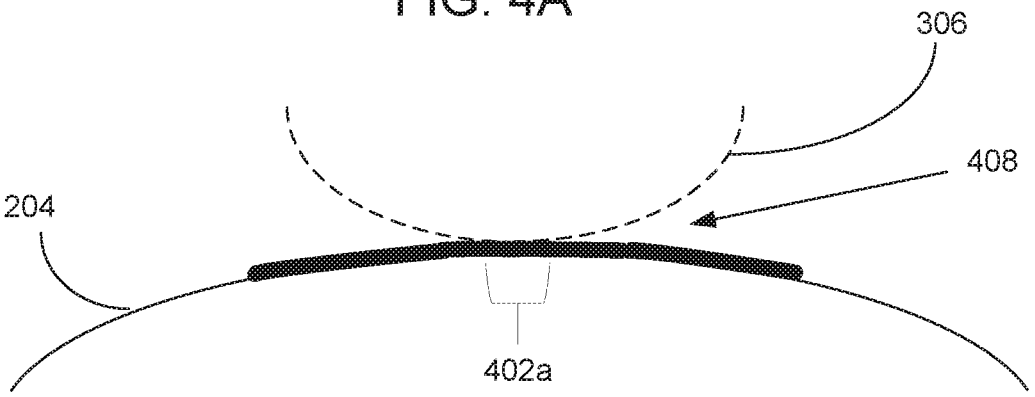

FIGS. 4A, 4B, 5A, and 5B are simple schematic diagrams that illustrate examples of utilizing an element contacting imaging oil at a photoconductive surface to address photoconductor reflectance variance issues during printing. Beginning at FIG. 4A, in an example a LEP printer 300 includes a rotatable drum 302 with a photoconductive surface 204 to be coated with an imaging oil 402. LEP printer 300 includes a flexible sheet 306 positioned to be in contact with imaging oil 402 at photoconductive surface 204 and the flexible sheet. Flexible sheet 306 has a first refractive index that is within a predefined tolerance of a second refractive index that is the refractive index imaging oil 402, FIG. 4B is an enlarged view of a portion of FIG. 4A, illustrating that flexible sheet 306 is to remain in sustained contact with the photoconductor surface 204 of drum 302, without air gaps, due to capillary action of imaging oil 402*a* present in a nip 408 between flexible sheet 306 and photoconductor surface 204.

Returning to FIG. 4A, in this example LEP printer 300 includes a charging device 404 and a writing component 406. Charging device 404 is to apply an electrical charge to photoconductive surface 204. As used herein, a "charging device" refers generally to any apparatus that is to accomplish electrostatic charging of a photoconductive surface. Charging device 404 may be or include a charge roller, corona wire, scorotron, or any other charging device. In examples, a uniform static charge is deposited on photoconductive surface 204 by charging device 404. In some examples, charging device 404 is to apply a negative charge to the surface of the photoconductor surface 402. In other implementations, the charge is a positive charge. As photoconductor surface 402 rotates, it passes writing component 406 where writing component emits light to dissipate localized charge in selected portions of the photoconductor surface 402 and thereby leave an invisible electrostatic charge pattern ("latent image") upon photoconductor surface 204. The latent image corresponds to the image to be printed by LEP printer 300.

Figure 5A:
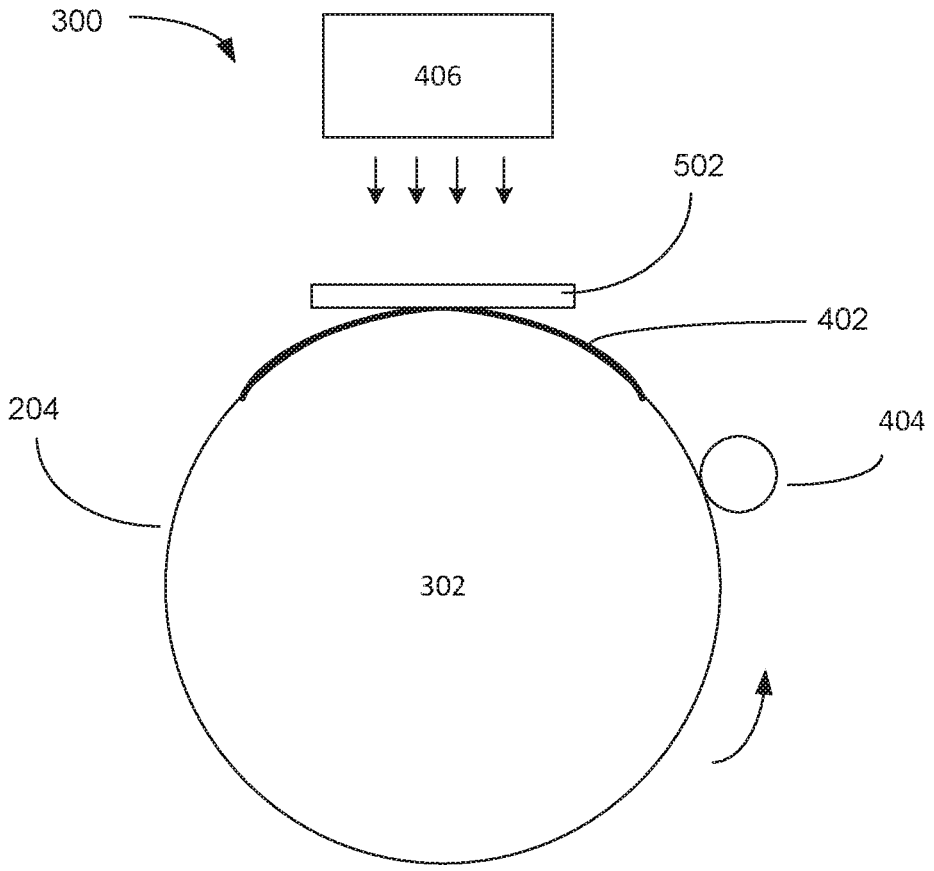

Moving to FIG. 5A, in this example LEP printer 300 is the same as depicted in and described with respect to FIG. 4A, except as the form of the element to be brought into contact with imaging oil 402. The example of FIG. 5A illustrates that the element to be brought into contact with imaging oil 402 photoconductor surface 204 can be an element other than a flexible sheet or flexible film. In the example of FIG. 5A, a rigid element 502 (e.g. a glass element or hardened plastic element) has a first refractive index that is within a predefined tolerance of a second refractive index of imaging oil 402 and is in contact with photoconductor surface 204.

Figure 5B:
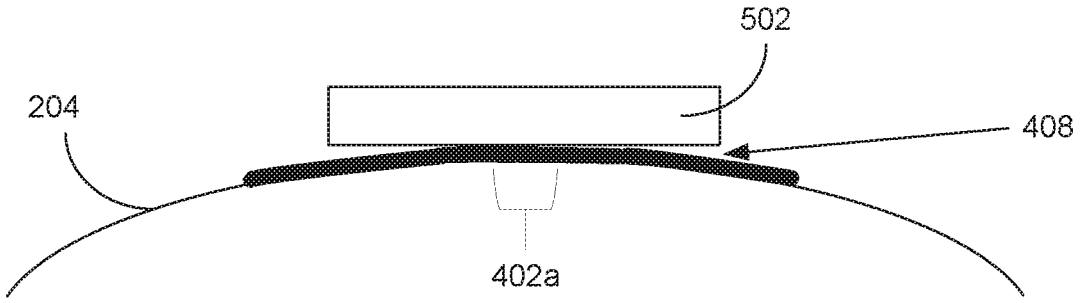

FIG. 5B is an enlarged view of a portion of FIG. 5A, illustrating that rigid element 502 is to be positioned to remain in continuous contact with the imaging oil at the photoconductor surface 204 of drum 302. This continuous contact is to avoid air gaps in the nip 408 between rigid element 502 and photoconductor surface 204. In examples, element 502 is to be brought just close enough to photoconductor surface 204, without physically touching it, so that capillarity will occur.

FIG. 6 is a simple schematic diagram illustrating an example of bringing an element into contact with imaging oil at a photoconductor surface. In this example, element 206 is brought into contact with imaging oil 202 at photoconductor surface 204, with the photoconductor surface having a chargeable layer 602 and a protective layer 604. Element 206 has a first refractive index that is within a predefined tolerance of a second refractive index of imaging oil 202. Photoconductor surface 204 is exposed to light 208 emitted by a writing component. Light 208 passes through element 206 and imaging oil 202 to strike photoconductor surface. In this example, light 208 passes through imaging oil layer 202, a transparent or semi-transparent protective layer 604, and then strikes chargeable layer 602 to selectively discharge the chargeable layer and thereby form a latent image.

FIG. 7 is a block diagram depicting an example of an optical device for reducing photoconductor reflectance variance issues during LEP printing. Optical device 700 includes an element 702 for placement within an LEP printer in contact with a photoconductor surface coated with imaging oil. Element 702 has a refractive index 704 that is within a predetermined tolerance of the refractive index of the imaging oil that element 702 is to be in contact with.

FIG. 8 is a schematic diagram showing a cross section of an LEP printer 300 including a system for reducing photoconductor reflectance variance issues during printing, according to another example of the principles described herein. In an example, an LEP printer 300 may include a photoconductive surface 204, a charging device 404, a writing component 406, an intermediate transfer member blanket 820, an impression cylinder 810, developer assemblies 812, a charging device 404, a first cylindrical drum 830, a second cylindrical drum 840, According to the example of FIG. 8, a pattern of electrostatic charge is formed on a photoconductive surface 204 by rotating a clean, bare segment of the photoconductive surface 204 under a charging device 404. The photoconductive surface 204 in this example is cylindrical in shape, e.g. is attached to a first cylindrical drum 830, and rotates in a direction of arrow 870. In other examples, a photoconductive surface may be planar or part of a belt-driven system.

Charging device 404 may include a charging device, such as a charge roller, corona wire, scorotron, or any other charging device. A uniform static charge is deposited on the photoconductive surface 204 by the charging device 404, As the photoconductive surface 204 continues to rotate, it passes a writing component 406 where one or more laser beams, LED, or other light sources dissipate localized charge in selected portions of the photoconductive surface 204 to leave an invisible electrostatic charge pattern ("latent image") that corresponds to the image to be printed. In some examples, the charging device 404 applies a negative charge to the surface of the photoconductive surface 204. In other implementations, the charge is a positive charge. The writing component 406 then selectively discharges portions of the photoconductive surface 204, resulting in local neutralized regions on the photoconductive surface 204.

Continuing with the example of FIG. 8, developer assemblies 812 are disposed adjacent to the photoconductive surface 204 and may correspond to various print fluid colors such as cyan, magenta, yellow, black, and the like. There may be one developer assembly 812 for each print fluid color. In other examples, e.g., black and white printing, a single developer assembly 812 may be included in LEP printer 300. During printing, the appropriate developer assembly 812 is engaged with the photoconductive surface 204. The engaged developer assembly 812 presents a uniform film of print fluid to the photoconductive surface 204. The print fluid contains electrically-charged pigment particles which are attracted to the opposing charges on the image areas of the photoconductive surface 204. As a result, the photoconductive surface 204 has a developed image on its surface, i.e. a pattern of print fluid corresponding with the electrostatic charge pattern (also sometimes referred to as a "separation").

The print fluid is transferred from the photoconductive surface 204 to blanket 820. The blanket may be in the form of a blanket attached to a rotatable second cylindrical drum 840. In other examples, the blanket may be in the form of a belt or other transfer system. In this particular example, the photoconductive surface 204 and blanket 820 are on drums 830 840 that rotate relative to one another, such that the color separations are transferred during the relative rotation. In the example of FIG. 8, the blanket 820 rotates in the direction of arrow 880. The transfer of a developed image from the photoconductive surface 204 to the blanket 820 may be known as the "first transfer", which takes place at a point of engagement between the photoconductive surface 204 and the blanket 820.

Once the layer of print fluid has been transferred to the blanket 820, it is next transferred to a print substrate. In this example, print substrate is a web substrate 850 moving along a substrate path in a substrate path direction 860. In other examples, the print substrate may a sheet substrate that travels along a substrate path. This transfer from the blanket 820 to the print substrate may be deemed the "second transfer", which takes place at a point of engage between the blanket 820 and the print substrate. The impression cylinder 810 can both mechanically compress the print substrate into contact with the blanket 820 and also help feed the print substrate. In examples, the print substrate may be a conductive or a non-conductive print substrate, including, but not limited to, paper, cardboard, sheets of metal, metal-coated paper, or metal-coated cardboard. In examples, the print substrate with a printed image may be moved to a position to be scanned by an inline color measurement device 826, such as a spectrometer or densimeter, to generate optical density and/or background level data.

Controller 828 refers generally to any combination of hardware and software that is to control part, or all, of the LEP printer 300 print process. In examples, the controller 828 can control the voltage level applied by a voltage source, e.g., a power supply, to one or more of the writing component 406, developer assemblies 812, the blanket 820, a drying unit, and other components of LEP printer 300. In examples, controller 828 additionally may calculate a target thickness for element 206 and cause an automatic selection of element 206 from a set of available elements according to the calculated target thickness. In a particular example, controller 828 may select element 206 from a set of available elements according to a calculated target or minimal thickness utilizing the formula $$T>\lambda^2/(2\cdot n_{ref}\cdot\Delta\lambda),$$

wherein T is thickness of the element,

λ is light source central wavelength, $\Delta\lambda$ is light source spectral width, and $n_{refr}$ is refractive index of the element.

In an example, controller 828 may cause LEP printer 300 or a computer in network connection with LEP printer 300 to send to a user of an instruction or a recommendation to utilize the selected element 206. In examples, the user instruction or recommendation be sent via a graphic user interface, display, text message, email or any other electronic communication medium.

FIGS. 1-8 aid in depicting the architecture, functionality, and operation of various examples. In particular, FIGS. 2-8 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 1 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A method for reducing photoconductor reflectance variance issues during printing, comprising:

applying an imaging oil upon a photoconductor surface;

bringing an element into contact with the imaging oil at the photoconductor surface, the element having a first refractive index that is within a predefined tolerance of a second refractive index of the imaging oil; and exposing the photoconductor surface to light emitted by a writing component, the light passing through the element and the imaging oil.

2. The method of claim 1, wherein the element is a flexible element.

3. The method of claim 1, wherein the element is one from the set of a plastic element and a glass element.

4. The method of claim 1, wherein the light emitted by the writing component has a wavelength range, and wherein the element is transparent to the light in the wavelength range.

5. The method of claim 1, wherein the element is to stay in contact with the surface without air gaps due to capillary action of imaging oil present in a nip between the element and the photoconductor surface.

6. The method of claim 1, wherein the photoconductor surface is an external surface of a drum, and further comprising causing the drum to rotate such that the photoconductor surface is exposed to light as the photoconductor surface of the drum passes the writing component.

7. The method of claim 1, wherein the exposure of the photoconductor surface to light is to form an electrostatic charge pattern upon the photoconductor surface, the pattern replicating an image to be printed.

8. The method of claim 1, further comprising selecting the element from a plurality of elements according to a target thickness, wherein the target thickness is calculated according the formula $T>\lambda^2/(2\cdot n_{refr}\cdot\Delta\lambda)$, wherein, wherein T is thickness of the element, $\lambda$ is light source central wavelength, $\Delta\lambda$ is light source spectral width, and $n_{refr}$ is refractive index of the element.

9. A LEP printer, comprising:

a rotatable drum with a photoconductive surface to be coated with imaging oil;

a writing component to selectively direct light at the photoconductive surface; and an optical sheet positioned to be in contact with imaging oil at the photoconductive surface, the sheet having a first refractive index that is within a predefined tolerance of a second refractive index of the imaging oil, whereby light from the writing component passes through the sheet and the imaging oil.

10. The LEP printer of claim 9, further comprising a charging device and a writing component, the charging device to apply an electrical charge to the photoconductive surface, and the writing component to expose the charged photoconductive surface with light at a range of wavelengths to form a latent image upon the photoconductive surface, and wherein the sheet is transparent to the light at the range of wavelengths.

11. The LEP printer of claim 9, wherein the photoconductive surface includes a chargeable layer and a protective layer, the protective layer being at least partially transparent and situated exterior to the chargeable layer; and wherein the imaging oil is in contact with the protective layer.

12. The LEP printer of claim 9, wherein the sheet is positioned to form a nip area between the sheet and the photoconductive surface, and wherein imaging oil is to remain in the nip area without air pockets due to capillary action.

13. An optical device for reducing photoconductor reflectance variance issues during LEP printing, comprising:

an element for placement within an LEP printer in contact with a photoconductor surface coated with imaging oil, the element having a refractive index that is within a predetermined tolerance of refractive index of the imaging oil, whereby light passes through the element and the imaging oil.

14. The optical device of claim 13, wherein the element is a flexible plastic sheet.

15. The optical device of claim 13, wherein the element is to be positioned to form a nip area between the element and the photoconductor surface, and wherein the element is to overlay the photoconductor surface without air pockets due to the presence of imaging oil in the nip area.

16. The LEP printer of claim 9, wherein the photoconductive surface comprises a chargeable layer underneath a protective layer, the imaging oil to be coated on the protective layer.

17. The LEP printer of claim 9, further comprising a controller to calculate which optical sheet from a set of available sheets should be used based on refractive index and thickness and output a user instruction to install a selected optical sheet.

18. The LEP printer of claim 17, wherein the controller is programmed to determine a target thickness of the optical sheet as:

$$T>\lambda^2/(2\cdot n_{reff}\cdot\Delta\lambda),$$

wherein T is thickness of the sheet, $\lambda$ is a central wavelength of the writing component, $\Delta\lambda$ is a spectral width of the writing component, and $n_{reff}$ is refractive index of the sheet.

19. The LEP printer of claim 9, wherein the optical sheet comprises a flexible sheet.

20. The optical device of claim 13, wherein:

the element compensates for variations in thickness of the imaging oil on the photoconductor surface; and capillary action of the element causes imaging oil to seal any air gap in a nip between the element and photoconductor surface.

* * * * *